United States Patent [19]

Daniels et al.

[11] Patent Number: 4,790,977

[45] Date of Patent: Dec. 13, 1988

[54] SILICON MODIFIED LOW CHROMIUM FERRITIC ALLOY FOR HIGH TEMPERATURE USE

[75] Inventors: James A. Daniels, Loveland; Joseph A. Douthett, Monroe, both of Ohio

[73] Assignee: Armco Advanced Materials Corporation, Lyndora, Pa.

[21] Appl. No.: 94,785

[22] Filed: Sep. 10, 1987

[51] Int. Cl.[4] ..... C22C 38/34

[52] U.S. Cl. ..... 420/104; 420/112; 420/117; 420/118; 75/246; 148/333

[58] Field of Search ..... 420/104, 112, 117, 118; 148/333, 12 F, 134; 75/245, 246

[56] References Cited

U.S. PATENT DOCUMENTS

| | | | |
|---|---|---|---|
| 1,322,511 | 11/1919 | Armstrong | 420/34 |
| 1,495,504 | 5/1924 | Armstrong | 420/104 |
| 1,521,736 | 1/1925 | Wendersee et al. | 420/104 |
| 2,165,035 | 7/1939 | DeLong et al. | 420/74 |
| 2,747,989 | 5/1956 | Kirkby et al. | 420/104 |
| 3,698,964 | 10/1972 | Caule et al. | 420/78 |
| 3,730,779 | 5/1973 | Caule et al. | 420/78 |
| 3,909,250 | 9/1975 | Jasper | 420/104 |
| 3,973,951 | 8/1976 | Satsumabayashi et al. | 420/104 |
| 4,141,724 | 2/1979 | Brickner et al. | 420/104 |
| 4,261,739 | 4/1981 | Douthett et al. | 420/34 |
| 4,640,722 | 2/1987 | Gorman | 420/34 |

FOREIGN PATENT DOCUMENTS

| | | | |
|---|---|---|---|
| 51-5616 | 2/1976 | Japan | 420/104 |
| 55-54550 | 4/1980 | Japan | 420/104 |

*Primary Examiner*—Deborah Yee

*Attorney, Agent, or Firm*—Larry A. Fillnow; Robert J. Bunyard; Robert H. Johnson

[57] ABSTRACT

A ferritic alloy steel having good creep strength and cyclic oxidation resistance at elevated temperatures up to 982° C. (1800° F.) with an optional final anneal at 1010°-1150° C. (1850°-2100° F.) consisting essentially of from about 0.01% to about 0.30% carbon, about 2% maximum manganese, greater than 2.35% to about 4% silicon, about 3% to about 7% chromium, about 1% maximum nickel, about 0.15% maximum nitrogen, less than 0.3% aluminum, about 2% maximum molybdenum, at least one element selected from the group of niobium, titanium, tantalum, vanadium and zirconium in an amount up to 1.0% and the balance essentially iron.

13 Claims, 5 Drawing Sheets

SILICON MODIFIED LOW CHROMIUM FERRITIC ALLOY FOR HIGH TEMPERATURE USE

BACKGROUND OF THE INVENTION

This invention relates to ferritic alloys having good elevated temperature properties and more specifically to ferritic alloys having chromium and silicon with good oxidation resistance and creep strength up to 982° C. (1800° F.).

Low cost alloys having good strength and oxidation resistance at elevated temperatures have been sought for many years to replace stainless steels and nickel base alloys. The use of chromium, aluminum and silicon in ferrous base materials has been explored in many combinations as set forth below.

U.S. Pat. No. 3,698,964 (Caule et al.) discloses an alloy having up to 2% carbon, 1–5% chromium, 1–4% silicon, 1–4% aluminum and up to 2% copper. The preferred silicon alloy has 3% chromium, 2% silicon and 0.25% maximum carbon.

U.S. Pat. No. 3,782,925 (Brandis et al.) teaches 1–3.5% aluminum, 0.8–3% silicon and 10–15% chromium for oxidation resistance up to about 1,000° C. (1832° F.).

U.S. Pat. No. 3,905,780 (Jasper et al.) teaches a low alloy substrate for aluminum coating which has up to 0.13% carbon, 0.5–3% chromium, 0.8–3% aluminum, 0.4–1.5% silicon, 0.1–1% titanium and remainder substantially iron.

U.S. Pat. No. 4,261,739 (Douthett, et al.) has one family of alloys with 6% chromium, 0.01% carbon, 0.4–1% silicon, 1.5–2% aluminum, 0.4% titanium, 0.4% columbium and balance essentially iron. A final annealing temperature of 1010°–1120° C. (1850°–2050° F.) is critical in obtaining good creep strength in combination with uncombined columbium. An alloy having 4–7% chromium is stated to survive temperatures up to 815° C. (1500° F.).

U.S. Pat. No. 4,640,722 (Gorman) teaches a ferritic alloy having 0.05% maximum carbon, 1–2.25% silicon, 0.5% maximum aluminum, 8–20% chromium, 0.05% maximum nitrogen. The aluminum is restricted because of porosity problems in weld areas. Silicon is taught to have an adverse affect on creep strength unless a high temperature final anneal is given.

Austenitic nickel cast irons known as NI-RESIST (trademark of International Nickel Company) having up to 3% carbon, 1–5% silicon, up to 6% chromium, 13.5–36% nickel, up to 7.5% copper, 0.5–1.6% manganese, 0.12% maximum sulfur, 0.3% maximum phosphorus and balance iron have been used for some elevated temperature applications but are expensive due to the large amounts of nickel present.

The low chromium ferritic alloys in the past have relied mainly on aluminum to replace chromium for oxidation resistance except where weldability is important. Silicon, while known to improve oxidation resistance, has been used mainly in an amount below 2% and in combination with large amounts of aluminum. Silicon has been previously regarded to have an adverse influence on creep stength. Alloys having less than about 8% chromium have been difficult to maintain fully ferritic, particularly if the carbon and nitrogen levels are much above 0.03% each. The prior art alloys having large amounts of aluminum have suffered during the casting operation because of fluidity problems and poor slagging and oxide conditions. The cast product has not provided good as-cast toughness. Existing materials for high temperature applications are thus very expensive or provide less than the desired properties when balanced to be more economical.

It is an object of the present invention to provide a fully ferritic alloy which has good creep strength, oxidation resistance and casting properties at elevated temperatures. It is a further object to provide an alloy having higher silicon levels while still maintaining good creep strength. It is also an object of the present invention to improve the strength levels of the motlen alloy to provide improved casting properties. A still further object of the invention is to provide a low chromium alloy with higher levels of carbon and nitrogen and still maintain a fully ferritic structure including service at elevated temperatures. The ferritic alloy composition is balanced to provide elevated temperature properties equivalent or superior to the more expensive nickel cast irons and Type 409 stainless steel.

SUMMARY OF THE INVENTION

The present invention constitutes a discovery in elevated temperature properties which results from high silicon additions to low chromium ferritic steels. This is achieved by a chromium-silicon balance for oxidation resistance and the use of higher carbon and nitrogen levels when combined with the addition of carbide/nitride formers selected from the group of niobium, tantalum, vanadium, titanium and zirconium. A further increase in creep strength may be provided by a small uncombined niobium content in combination with a final anneal of from 1010° C. to 1150° C. (1850° F. to 2100° F.). This inexpensive ferritic alloy has excellent oxidation resistance up to temperatures approaching 982° C. (1800° F.) and is superior to Type 409 stainless steel, particularly in regards to cyclic oxidation.

According to the broadest aspect of the invention there is provided a ferritic steel exhibiting improved cyclic oxidation resistance and good creep strength at temperatures of at least 870° C. (1600° F.) and as high as 982° C. (1800° F.), consisting essentially of, by weight %, from about 0.01% to 0.3% carbon, about 2% maximum manganese, greater than 2.35% to about 4% silicon, about 3% to about 7% chromium, about 1% maximum nickel, about 0.15% maximum nitrogen, less than 0.3% aluminum, about 2% maximum molybdenum, at least one element selected from the group of niobium, tantalum, vanadium, titanium and zirconium in an amount up to 1.0% and the balance essentially iron. These steels are intended primarily for use as-cast and are thus designed to maximize strength at temperature by balancing the compositional elements described previously. The steels of the invention may be further provided with a high temperature final anneal of from 1010° C. to 1150° C. (1850° F. to 2100° F.). Ferritic steel articles produced from these compositions have properties superior to Type 409 stainless steel and are far less expensive.

DETAILED DESCRIPTION OF THE PREFERRED EMBODIMENT

Figure 1:
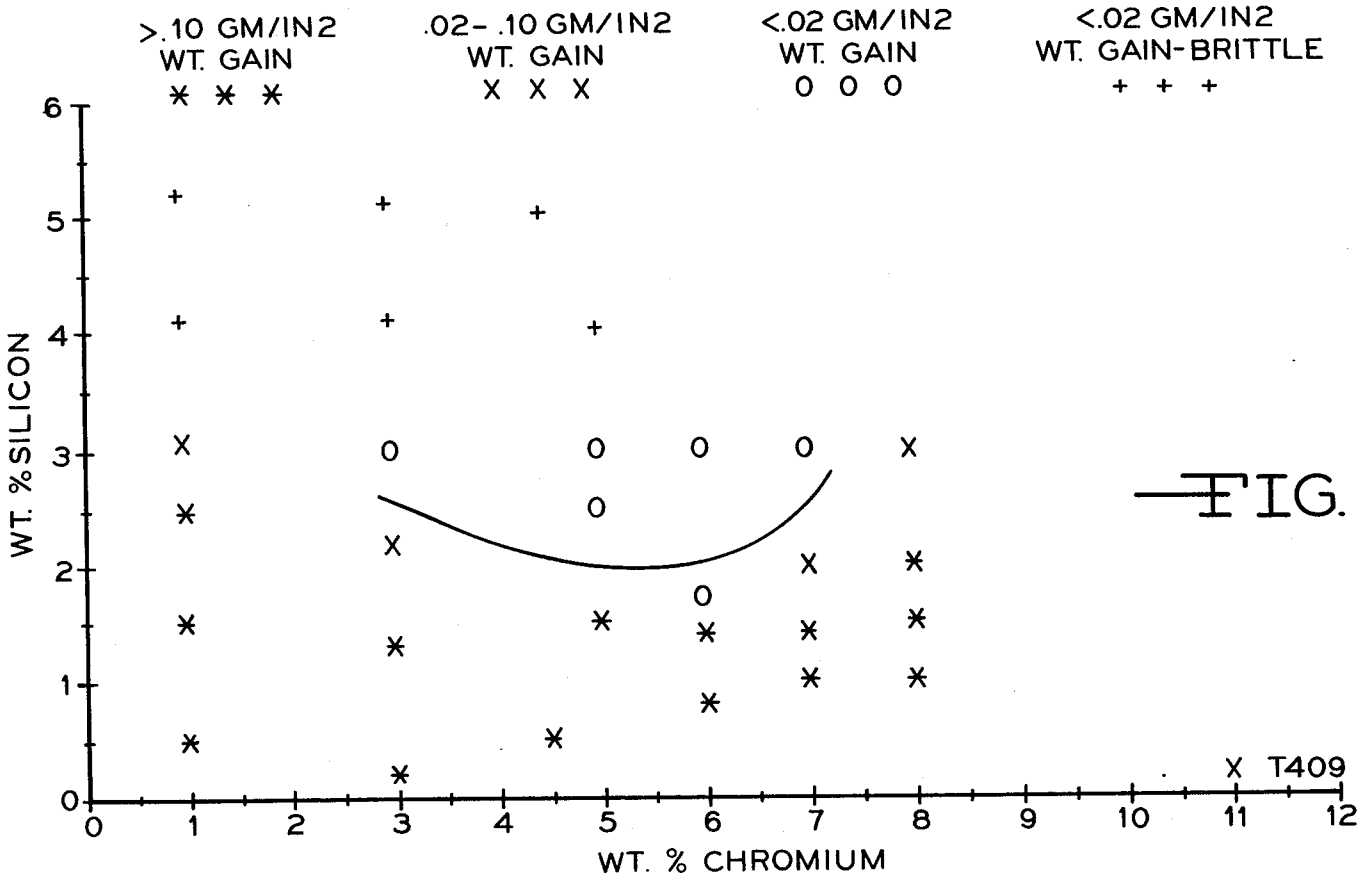
FIG. 1 is graph showing the relationship between the chromium and silicon content on cyclic oxidation resistance at 1700° F.

It has been discovered that marked improvement in creep strength at 40 elevated temperatures can be obtained in low chromium ferritic steels by a critical silicon addition in combination with carbide/nitride control and grain size control.

Silicon has long been recognized for its improvement to oxidation resistance but has rarely been used in levels above 2%. Silicon has also been found to promote Laves phase (U.S. Pat. No. 4,640,722) when used with uncombined niobium and a final anneal above 1010° C. (1850° F.) which improves creep strength. However, when the high temperature final anneal is eliminated in U.S. Pat. No. 4,640,722, the drawing shows that increasing silicon from 1% to 2.4% decreases the creep strength.

The present invention has discovered higher silicon levels will restrict the level of carbon and nitrogen in solid solution (decrease the solubility of each element). Previously, low chromium alloys generally restricted the carbon and nitrogen to levels below 0.05% to maintain a fully ferritic structure. Silicon levels above 2.35%, and preferably 2.5%–3.5%, allow higher carbon levels (up to 0.3%) while still maintaining a ferritic structure when the addition of a strong carbide former is included. The silicon acts to drive the carbide or nitride forming reaction to greater completion so more precipitates are formed and less carbon or nitrogen is left in solid solution. Silicon has a strong role in providing oxidation resistance up to 982° C. (1800° F.) when combined with the chromium levels of the invention (about 3% to about 7%). The chromium-silicon relationship must also be balanced to avoid spalling. Silicon will also tend to promote Laves phase when soluble niobium is present and a final annealing temperature above 1010° C. (1850° F.) is employed. As many of the intended end uses of these steels are castings, high silicon would be beneficial from a fluidity and castability standpoint.

As mentioned above, the control of carbide and nitride precipitates is critical to obtain the desired high temperature properties and maintain a ferritic structure. The higher levels of carbon in the present steels of the invention provide solid solution strengthening and/or promote austenite during casting of the molten steel at temperatures above the temperature at which the precipitates form. These temperatures are in excess of 2000° F. (1095° C.), which is far above the service temperatures contemplated for these alloys. This level of strength is important to provide sufficient strength for solidification (avoidance of cast surface tears) during continuous casting. These steels are designed to be continuous castable and later remelted to smaller sized parts of use. While austenite can be tolerated during continuous casting and in fact may be desirable for strength, the presence of austenite during service conditions is not desirable due to its detrimental effect on oxidation resistance. As the various precipitates form during cooling, they provide a major source of improvement for creep strength. The higher level of carbon produces a greater volume of carbides. The high silicon level drives the carbide forming reaction to even greater completion. The proper use of carbides and nitrides will control grain size and also act to pin the grain boundaries. Both mechanisms relate to improved creep strength. Fine grain size may be provided by carbide and nitride control for improved toughness and ductility in the as-cast condition. For applications where a high temperature anneal above 982° C. (1850° F.) is not easily conducted, such as exhaust manifolds, the carbon levels are above 0.05% and preferably above 0.10%. High temperature creep properties can be provided without using the high temperature anneal. This invention uses the carbides that form during cooling from the molten state to pin grain boundaries while U.S. Pat. Nos. 4,261,739 and 4,640,722 relied on Laves phase formation during service to pin grain boundaries and retard creep.

Niobium is a preferred alloying element for control of carbon and nitrogen. Levels of niobium up to 1.0% are acceptable while attempting to keep the alloy costs to a low level. A preferred upper limit is 0.5% and if added, should be present in an amount exceeding 0.05% and preferably above 0.1%. It is important to note the improved creep properties do not require the niobium to fully stabilize the carbon and nitrogen content. Niobium precipitates form at temperatures below 1095° C. (2000° F.) and thereby allow more carbon to be in solid solution during higher temperature solidification. As the steel cools from solidification, or a high temperature exposure above 2000° F. (1095° C.), the carbides of niobium will form and be small, numerous and normally distributed at already existing grain boundaries. Since they do not precipitate at high temperatures, the average ferritic grain size is larger which improves creep strength. The niobium carbides/nitrides contribute to the pinning of the grain boundaries during subsequent high temperature service and the pinning and dispersion strengthening develops improved creep strength by retarding grain boundary slip, a dominant creep mechanism in iron based alloys. If the alloy is given a high temperature anneal to promote later in-service Laves phase formation, the uncombined niobium should be at least 0.10%.

Titanium is also a preferred precipitate former which develops optimum properties when combined with niobium. Titanium in levels up to 1.0% and preferably up to 0.5% will combine with carbon and nitrogen at higher temperatures and thus come out of solution sooner during solidification cooling. Titanium carbonitrides are thus formed or forming as the grains solidify. Titanium precipitates will tend to keep the grains from becoming too large (an as-cast toughness problem) and also contribute to a more uniform and refined carbide dispersion (when coupled with niobium) which resists coarsening. One must also remember the titanium precipitates will have more time at elevated temperatures and may become coarser. The optimum conditions will be provided by a dual carbide/nitride precipitation system.

Vanadium, tantalum and zirconium may be substituted as the carbide/nitride formers at levels up to 1.0% but are preferably added at levels below 0.5%. Zirconium is used to control grain coarsening similar to titanium and vanadium and tantalum function similar to niobium.

Those skilled in the art will appreciate the ferritic steels of the invention will be substantially ferritic during the initial solidification process due to the composition balance although the excess carbon anad nitrogen in solution may cause some strengthening austenite to form with additional cooling. The steels will transform to 100% ferrite during the subsequent cooling below 2000° F. (1093° C.) and remain ferritic during use at elevated temperatures. The level of austenite forming elements such as carbon and nitrogen in solution must be low enough to prevent austenite reforming at any temperatures of intended use. Such reformation would lead to dimensional changes and be detrimental to oxidation resistance. At the levels of carbon and nitrogen remaining in solution after the additions of titanium and niobium, the steels of this invention will not form austenite at the temperatures of use below 2000° F. (1093° C.).

Chromium is essential to the oxidation resistance and cyclic oxidation resistance in particular. Based on the work shown in FIG. 1, the levels of chromium have been defined by the requirements at 927° C. (1700° F.) for cyclic oxidation resistance. Levels of about 3% to about 7% will provide less than 0.02 gm/in$^2$ weight gain when combined with greater than 2.35% to 4% silicon. These ranges will also avoid brittleness as was detected for higher silicon melts exhibiting less than 0.02 gm/in$^2$ weight gain. Chromium within this range when combined with the preferred carbon, silicon, titanium and niobium levels will provide superior creep strength as compared to typical stainless steels having 12% or more chromium.

Molybdenum could be added to the present alloy in amounts up to 2 or 3% to improve high temperature strengths but is generally not included in order to keep the cost of the alloy low. Molybdenum is generally regarded as a chromium substitute and solid solution strengthener but tends to detract from oxidation resistance due to its sublimation tendencies.

Nitrogen will normally be present at a level of about 0.03% which occurs as a result of standard melting conditions. Nitrogen may be used up to 0.15% as a strengthening agent and creep retardant precipitate if the carbon levels are low. A preferred range is 0.10% maximum and more preferred is 0.05% maximum.

Manganese should be restricted to levels below 2% and preferably 1% since it promotes or stabilizes austenite which has an adverse influence on the oxidation resistance of ferritic alloys. Manganese itself is not an oxidation resistance improving element and would increase carbide or nitride solubility so that less precipitates form upon cooling.

Nickel should also be restricted to low levels to avoid the formation of austenite. An upper limit of 1% is suggested and preferably is maintained below 0.5%.

Aluminum is not required in the steel of the present invention. While it is more common to use aluminum than silicon in ferritic alloys having chromium, the combination of creep strength and oxidation resistance is improved by using silicon. Aluminum is preferably maintained at levels below 0.3%. Aluminum may be used as a deoxidizer during melting. For casting purposes aluminum additions can lead to slagging and oxide problems and are not generally regarded as improving fluidity or as-cast toughness.

Any one or more of the preferred or more preferred ranges indicated above can be used with any one or more of the broad ranges for the remaining elements set forth above.

The steel of the invention may be melted and cast using conventional mill equipment. The cast material may be readily converted into a variety of wrought product forms such as strip, sheet, bar, rod, wire and billets. The steel may also be used in the as-cast condition such as in automotive exhaust manifolds.

A number of experimental heats of steels of the invention have been prepared and compared to existing ferritic stainless steels or existing low chromium ferritic alloys. These are shown in TABLE 1.

TABLE 1

| | (Weight %) | | | | | | | | | | |
|---|---|---|---|---|---|---|---|---|---|---|---|
| Heat No. | C | Mn | Cr | Si | N | Nb | Ti | Ni | P | S | V |
| 1 | .02 | .52 | 4.84 | 2.90 | .007 | — | — | .48 | .005 max | .005 max | |
| 2 | .05 | .51 | 4.80 | 2.90 | .008 | — | — | .49 | " | " | |
| 3 | .08 | .51 | 4.90 | 2.92 | .008 | — | — | .47 | " | " | |
| 4 | .13 | .49 | 4.93 | 2.90 | .008 | — | — | .47 | " | " | |
| 5 | .10 | .54 | 5.03 | 2.95 | .012 | — | — | .48 | " | " | .54 |
| 6 | .02 | .16 | 4.80 | 4.11 | .011 | — | .31 | .01 | " | " | |
| 7 | .02 | .19 | 4.82 | 5.31 | .012 | — | .28 | .01 | " | " | |
| 8 | .02 | .16 | 2.98 | 3.01 | .010 | — | .30 | .01 | " | " | |
| 9 | .01 | .18 | 2.96 | 4.25 | .009 | — | .31 | .01 | " | " | |
| 10 | .02 | .18 | 2.89 | 5.26 | .008 | — | .31 | .01 | " | " | |
| 11 | .02 | .16 | 0.98 | 3.13 | .011 | — | .30 | .01 | " | " | |
| 12 | .02 | .16 | 0.99 | 4.13 | .009 | — | .31 | .01 | " | " | |
| 13 | .02 | .18 | 0.97 | 5.23 | .009 | — | .31 | .01 | " | " | |
| 14 | .01 | .15 | 5.10 | 3.25 | .010 | — | .40 | .01 | " | " | |
| 15 | .13 | .54 | 5.17 | 3.32 | .012 | .16 | .01 | .49 | " | " | |
| 16 | .13 | .52 | 5.16 | 3.28 | .012 | .28 | — | .49 | " | " | |
| 17 | .13 | .53 | 5.18 | 3.32 | .013 | .37 | — | .49 | " | " | |
| 18 | .13 | .52 | 5.17 | 3.27 | .011 | .47 | .01 | .48 | " | " | |
| 19 | .13 | .53 | 5.20 | 3.37 | .012 | .16 | .13 | .48 | " | " | |
| 20 | .13 | .53 | 5.18 | 3.36 | .013 | .37 | .12 | .48 | " | " | |
| 21 | .15 | .54 | 5.19 | 3.32 | .012 | — | .01 | .50 | " | " | |
| 22 | .17 | .53 | 5.20 | 3.34 | .012 | — | .01 | .49 | " | " | |
| 23 | .03 | .54 | 5.19 | 3.34 | .013 | .16 | .13 | .49 | " | " | |
| 24 | .03 | .54 | 5.20 | 3.32 | .013 | .36 | .14 | .49 | " | " | |
| 25 | .03 | .55 | 5.18 | 3.42 | .010 | .37 | .01 | .48 | " | " | |
| 26 | .19 | .51 | 5.19 | 3.28 | .011 | .01 | | .48 | " | " | |
| 27 | .01 | .21 | 5.92 | 1.32 | .012 | — | .31 | .01 | " | " | |
| 28 | .01 | .21 | 5.80 | 0.92 | .008 | — | .34 | .01 | " | " | |
| 29 | .01 | .22 | 5.97 | 1.77 | .011 | — | .35 | .03 | " | " | |

TABLE 1-continued

| Heat No. | C | Mn | Cr | Si | N | Nb | Ti | Ni | P | S | V |
|---|---|---|---|---|---|---|---|---|---|---|---|
| | | | | | (Weight %) | | | | | | |
| 30 | .01 | .21 | 6.00 | 2.98 | .010 | — | .39 | .01 | " | " | |
| 31 | .01 | .18 | 6.81 | 1.00 | .012 | — | .40 | .01 | " | " | |
| 32 | .01 | .18 | 6.72 | 1.41 | .012 | — | .40 | .01 | " | " | |
| 33 | .01 | .18 | 6.84 | 1.93 | .011 | — | .46 | .01 | " | " | |
| 34 | .01 | .20 | 7.10 | 2.96 | .017 | — | .41 | .01 | " | " | |
| 35 | .01 | .20 | 7.89 | 1.03 | .013 | — | .35 | .01 | " | " | |
| 36 | .01 | .20 | 8.03 | 1.54 | .010 | — | .34 | .01 | " | " | |
| 37 | .01 | .20 | 7.93 | 1.99 | .017 | — | .38 | .01 | " | " | |
| 38 | .02 | .19 | 7.87 | 3.06 | .010 | — | .32 | .01 | " | " | |
| 39 | .02 | .18 | 6.96 | 1.89 | .014 | .15 | .32 | .01 | " | " | |
| 40 | .02 | .47 | 6.95 | 2.02 | .019 | .15 | .33 | .01 | " | " | |

FIG. 1 shows the cyclic oxidation criteria for selecting the silicon-chromium balance. A weight gain of less than 0.02 gm/in$^2$ at 1700° F. (927° C.) after 420 cycles of 25 minutes in the furnace and 5 minutes out of the furnace was selected as most appropriate. To obtain this level or resistance to cyclic oxidation without brittleness requires the alloy to have about 3% to about 7% chromium and silicon greater than 2.35% to about 4%. The steels for this study had about 0.015% carbon, about 0.2% manganese, less than 0.005% phosphorous, less than 0.003% sulfur, less than 0.5% nickel, about 0.25% titanium, less than 0.01% nitrogen and about 0.05% niobium. It should be noted that Type 409 stainless had a weight gain above 0.10 gm/in$^2$ under the same test conditions.

Figure 2:
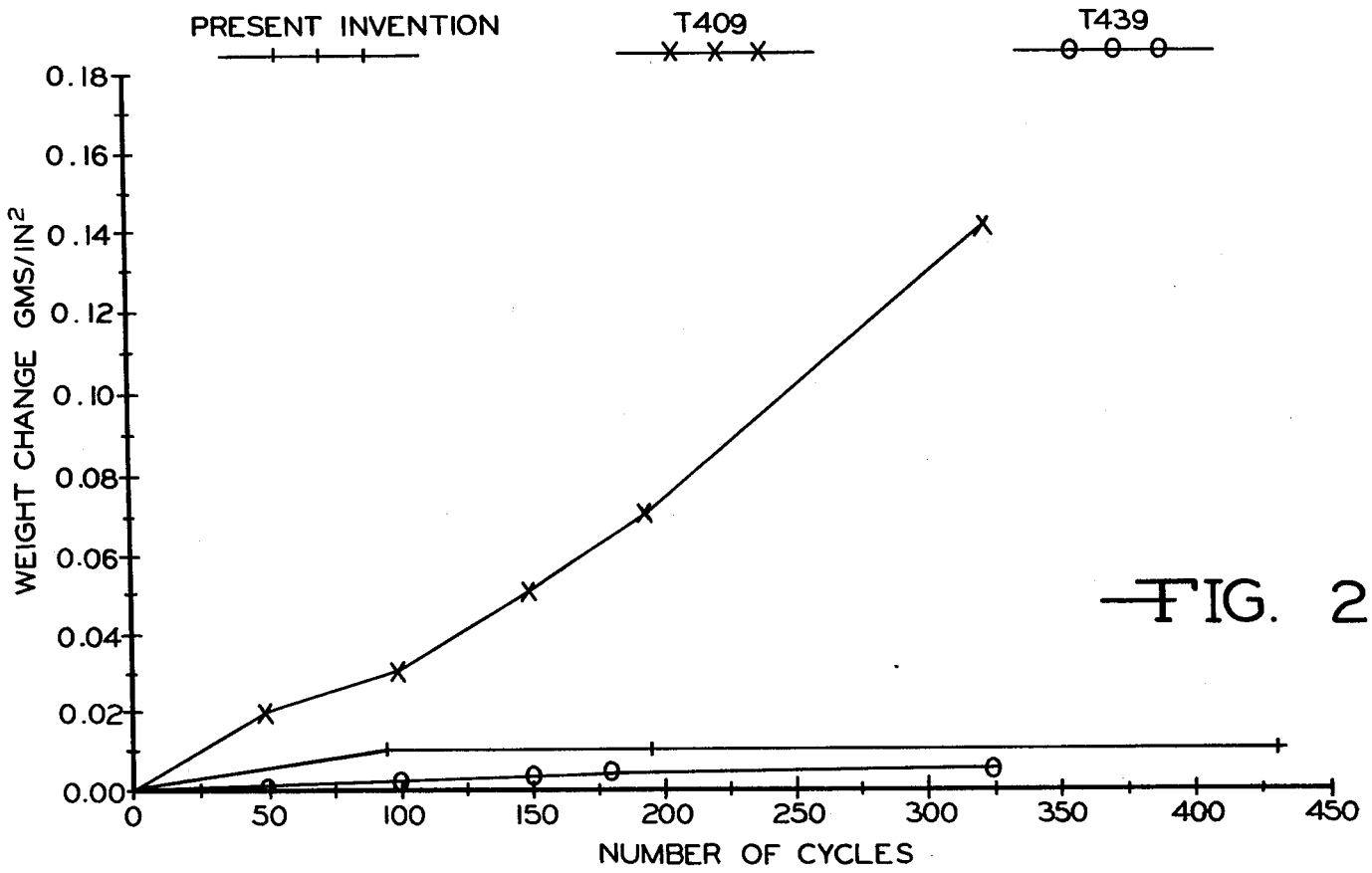
FIG. 2 is graph showing the cyclic oxidation resistance at 1700° F. in comparison with T439 and T409 stainless steels.

FIG. 2 shows the higher carbon version (0.13%) of the invention also outperforms Type 409 in cyclic oxidation resistance at 1700° F. (927° C.) and is below the 0.02 gm/in$^2$ criteria after 420 cycles. The cycle conditions are the same as in FIG. 1. Obviously, the soluble carbon level at these test temperatures is not high enough to permit any austenite to form in-service.

The creep strength of an alloy is closely related to a sag or deflection test as described in U.S. Pat. No. 4,261,739 in column 10, lines 22–68. Basically, the test measures the samples deflection (or sag) over 10 inches (25.4 cm) of unsupported length on a test rack in a furnace.

Figure 3:
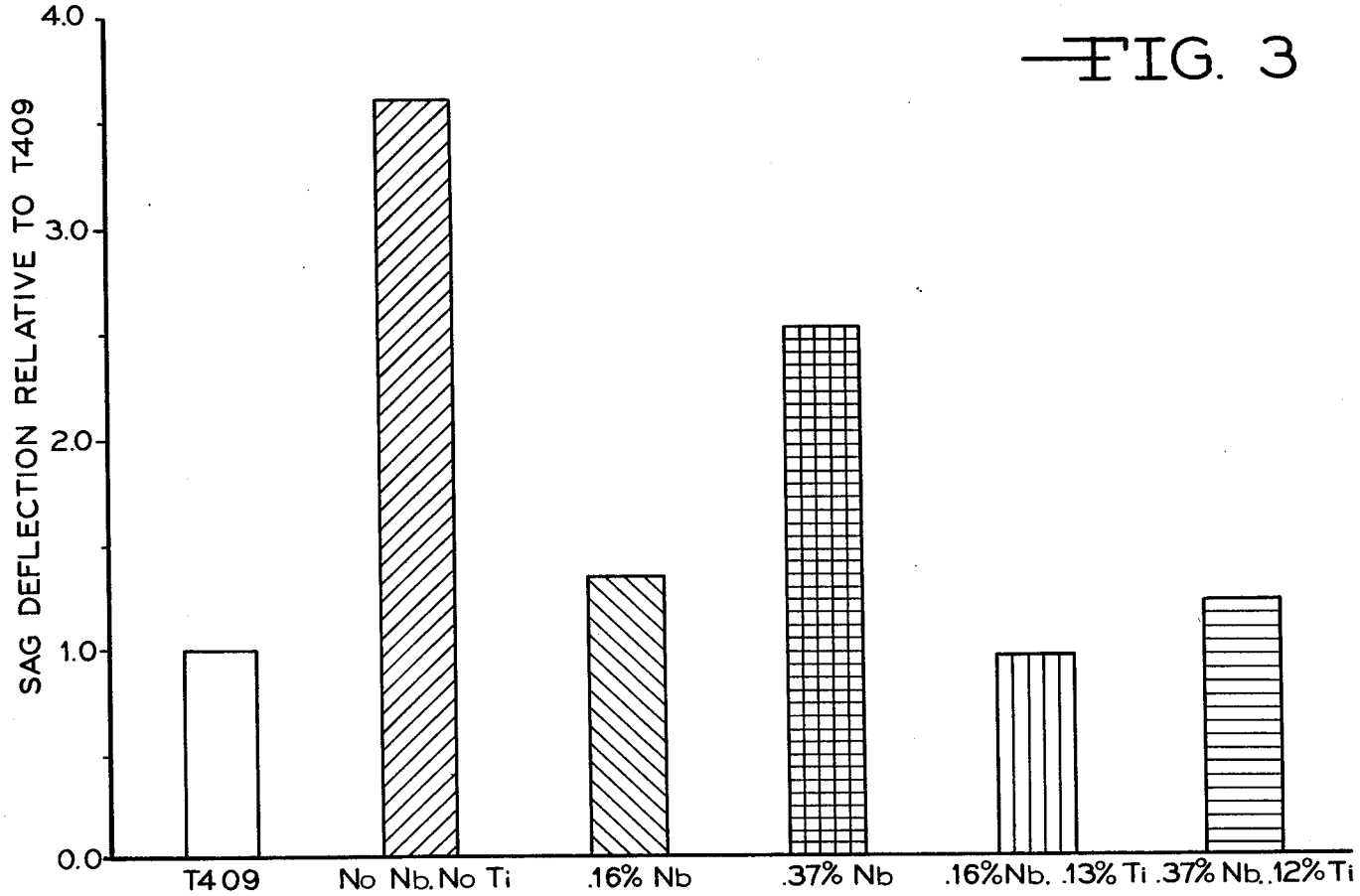
FIG. 3 is a chart showing the influence of titanium and niobium on the sag strength at 1600° F. in comparison with T409 stainless steel.

FIG. 3 shows the influence of niobium and titanium on the steels of the invention at 1600° F. (872° C.). The steels having 0.13% carbon (which unstabilized do not form austenite at 1600° F.) do not have creep strength comparable to 11% chromium T409 unless the carbide precipitates are optimized. Niobium levels of about 0.15% are preferable to 0.37%. Adding niobium improves creep resistance; however, the benefit appears to wane at higher than 0.37% niobium levels due possibly to niobium precipitate coarsening. Adding titanium at either niobium level improves the sag resistance. It is hypothesized, the dual carbide formers give a finer, more dispersed precipitate phase which is more effective in pinning the ferritic grain boundaries. Based on the stoichiometric relationships of titanium and carbon and niobium and carbon, 0.37% niobium would be expected to tie up (as a carbide) 0.048% of the carbon in this 0.13% carbon analysis. A melt containing 0.16% niobium and 0.13% titanium would find 0.021% and 0.032% carbon respectively combined as a niobium and titanium carbide. Thus, while approximately the same total amount of carbon has been precipitated in these two steels, the dual carbide melt appears over twice as creep resistant due to the two-carbide system promoting a finer, more dispersed carbide network.. From FIG. 3, a combination of about 0.15% titanium and 0.15% niobium appears to be close to optimum for sag resistance assuming the material is not given a high temperature final anneal.

FIG. 4 again shows the benefit of carbide, particularly dual carbide precipitation on creep strength at 1600° F. (872° C.). With the addition of 0.37% niobium to the base 5% chromium-3% silicon steel alloy, two levels of carbon, 0.03% ad 0.13%, were studied. From stoichiometric considerations, the amount of carbon which would be tied up as a carbide would be 0.03% and 0.048% in the 0.03% and 0.13% carbon melts respectively. The higher base carbon heat appears more sag resistant as would be predicted due to a higher volume fraction of carbide. To the base 0.03% and 0.13% carbon melts, 0.12 to 0.14% titanium is now added as a dual carbide stabilizer to go along with the 0.37% niobium. It can again be seen that the dual carbide system is more creep resistant at both carbon levels seen though the 0.03% carbon analysis would not be predicted to have a greater volume fraction of carbides (carbides should be finer and more dispersed) as a result of adding titanium. On FIG. 4, a horizontal line is drawn to show the relative position of Type 409's sag strength at 1600° F. (872° C.). The dual carbide heats can be seen to offer sag resistance equivalent to this Type 409 standard.

Figure 4:
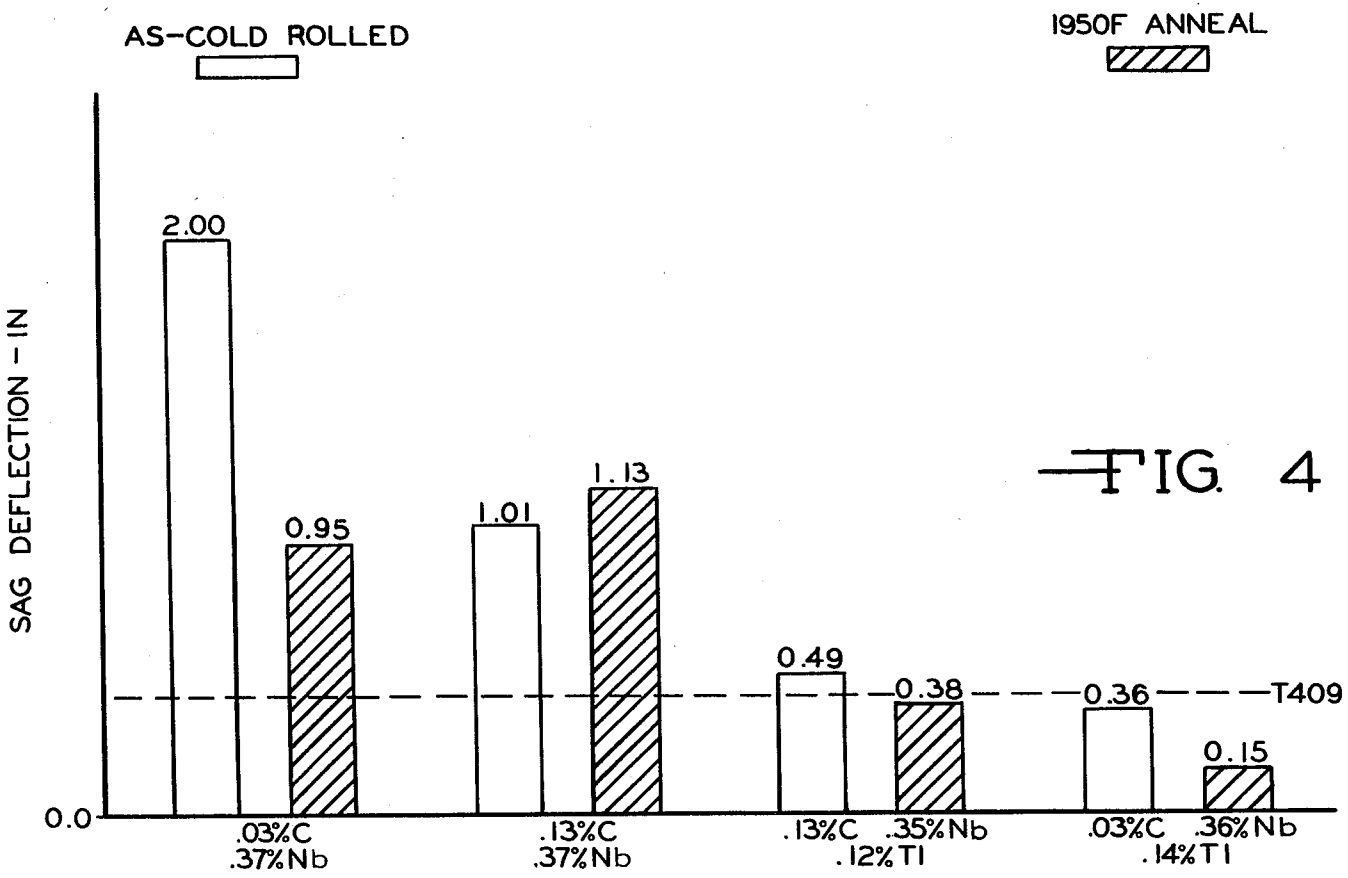
FIG. 4 is a chart showing the influence of carbide precipitation on creep strength at 1600° F. as measured by the sag test.

The as-cold rolled samples of FIG. 4 would be expected to represent as-cast properties. If a 1950° F. (1066° C.) anneal is included prior to sag testing, Laves phase formation becomes a potential strengthening mechanism. The Douthett et al. (U.S. Pat. No. 4,261,739) and Gorman (U.S. Pat. No. 4,640,722) patents teach Laves phase formation is promoted by soluble niobium levels coupled with the presence of silicon and the benefit to a high temperature solution anneal. The two 0.03% carbon-0.37% niobium heats with and without titanium would have soluble niobium levels and did benefit from the 1950° F. final aneal as far as sag strength was concerned. The 0.13% carbon heats with no soluble niobium level show little or no benefit from anneals at 1950° F. (1066° C.). Thus the steels of this invention could be further strengthened for elevated temperature service if the carbon and niobium relationship was balanced to have the niobium/carbon ratio be in excess of 7.75 so that excess niobium were present. The Laves phase strengthening relationship would also require as-cast parts to be given a final high temperature heat treat. However, it is the intent of this invention not to rely on the Laves phase formation to improve sag strength but to use the synergistic strengthening of dual carbides of most notably niobium and titanium.

Figure 5:
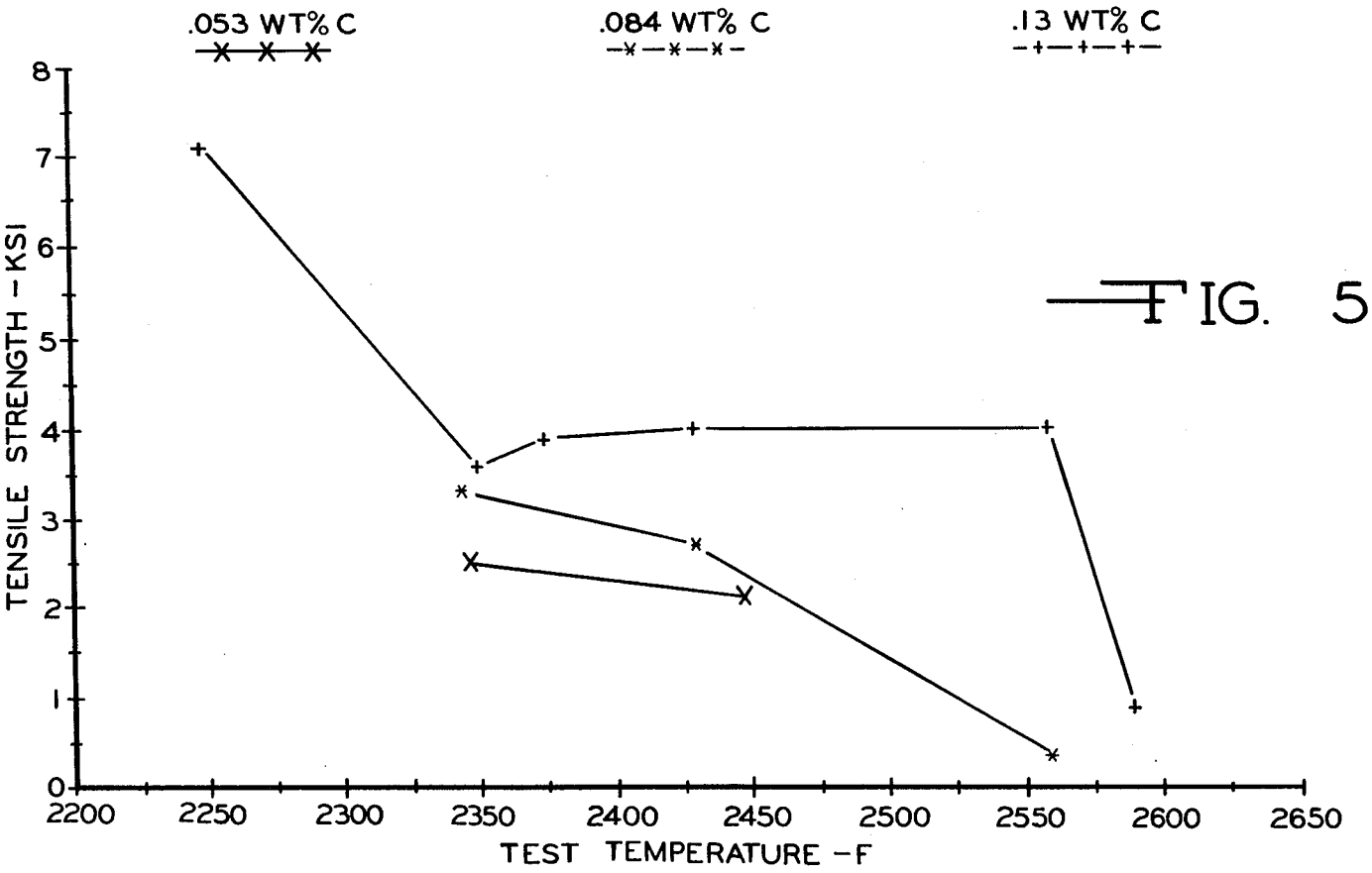
FIG. 5 is a graph showing the influence of carbon content on the strength of the molten metal of the invention during casting.

FIG. 5 shows the influence of carbon on the strength of the alloy to allow casting, particularly continuous casting. Increasing carbon is extremely beneficial in this regard. However, levels in excess of 0.15% must be balanced to provide a substantially ferritic structure at service under 2000° F. (1093° C.). Higher levels of carbide formers are required to take the carbon out of solution and avoid martensite at room temperature. While a martensitic alloy may provide better strength during continuous casting (be more austenitic during casting solidification), the benefits of a ferritic material regarding thermal expansion, conductivity and cyclic oxidation resistance will be sacrificed during subsequent service at lower temperatures. It is important in this invention that the soluble carbon level be controlled using stabilizers so that no austenite is formed under 2000° F. (1093° C.) but that above 2000° F. (1093° C.) a partially austenitic structure with soluble carbon levels of 0.10% or higher could be present to permit continuous castability.

The alloy steel of the present invention will thus provide cyclic oxidation at 1700° F. (937° C.) after 420 cycles (25 minutes in furnace/5 minutes out) of less than 0.02 gm/in$^2$ weight gain and a creep strength equivalent to Type 409 stainless when not given a high temperature final anneal or a creep strength better than Type 409 stainless when final annealed at 1010°–1150° C. (1850° F.–2100° F.). The critical control of a dual carbide/nitride precipitate system is also essential in the optimum control of grain size and grain boundary pinning to provide excellent creep strength at elevated temperatures. The silicon-rich oxide which forms during service at elevated temperatures up to 1800° F. (982° C.) forms a more adherent film which resists spalling better than a chromium-rich oxide.

Various changes and modifications may be made in the specific embodiments set forth above without departing from spirit of the invention. The specific embodiments are thus illustrative of the invention and not by way of limitation.

We claim:

1. A ferritic steel alloy having good oxidation resistance and creep strength at elevated temperatures, said alloy consisting essentially of, by weight percent, from about 0.01% to about 0.3% carbon, about 2% maximum manganese, greater than 2.35% to about 4% silicon, about 3% to about 7% chromium, about 1% maximum nickel, about 0.15% maximum nitrogen, less than 0.3% aluminum, at least one carbide and nitride forming element selected from the group of niobium, tantalum, vanadium, titanium and zirconium in an amount up to 1.0% sufficient to maintain a ferritic structure, provide a fine grain size and pin the grain boundaries to improve creep strength, and control the level of carbon and nitrogen in solution to prevent austenite formation and the balance essentially iron.

2. The ferritic steel claimed in claim 1 consisting essentially of from above 0.06% to 0.15% carbon, about 2.5% to about 3.75% silicon, about 3% to 5% chromium, about 0.1% maximum nitrogen with the sum total of carbon plus nitrogen not exceeding 0.2%.

3. The steel claimed in claim 2 having at least 0.10% uncombined niobium and a final anneal of from 1010° C. to 1150° C. (1850° F. to 2100° F.).

4. The steel claimed in claim 1 wherein niobium from 0.1% to 0.75% and titanium from 0.05% to 0.75% are added.

5. The steel claimed in claim 4 having a final anneal of from 1010° C. to 1150° C. (1850° F. to 2100° F.) and at least 0.10% uncombined niobium.

6. An article for service at temperatures up to 982° C. (1800° F.) having good oxidation and creep resistance, said article consisting essentially of, by weight %, from about 0.01% to about 0.3% carbon, about 2% maximum manganese, greater than 2.35% to about 4% silicon, about 3% to about 7% chromium, about 1% maximum nickel, about 0.15% maximum nitrogen, less than 0.3% aluminum, at least one carbide and nitride forming element selected from the group of niobium, tantalum, vanadium, titanium and zirconium in an amount up to 0.75% sufficient to maintain a ferritic structure, provide a fine grain size and pin the grain boundaries to improve creep strength, and control the level of carbon and nitrogen in solution to prevent austenite formation and the balance essentially iron.

7. The article as claimed in claim 6, wherein said article consists essentially of from above about 2.5% to about 3.75% silicon, about 3% to 5% chromium, above about 0.06% to 0.15% carbon, about 0.1% maximum nitrogen with the sum total of carbon plus nitrogen not exceeding 0.2%.

8. The article as claimed in claim 7, wherein said article has at least 0.10% uncombined niobium and has been given a final anneal of from 1010° C. to 1150° C. (1850° F. to 2100° F.).

9. The article as claimed in claim 6 consisting essentially of 0.06% to about 0.30% carbon, 0.5% maximum niobium and 0.75% maximum titanium.

10. The article as claimed in claim 7 wherein said article is a cast exhaust manifold.

11. The article as claimed in claim 6 wherein said article includes ferritic steel strip, sheet, plate, billet, bar, rod, wire or powder metal article.

12. The ferritic steel alloy claimed in claim 1 wherein said carbide and nitride forming element is in an amount of about 0.05% to 0.75%.

13. The article claimed in claim 6 wherein said carbide and nitride forming element is in an amount of about 0.05% to 0.75%.

* * * * *